US006173723B1

(12) United States Patent
Wang

(10) Patent No.: US 6,173,723 B1
(45) Date of Patent: Jan. 16, 2001

(54) STRUCTURE OF A SKELETON FOR UMBRELLAS

(76) Inventor: Mao-Sheng Wang, P.O. Box 82-144, Taipei (TW)

( * ) Notice: Under 35 U.S.C. 154(b), the term of this patent shall be extended for 0 days.

(21) Appl. No.: 09/407,291

(22) Filed: Sep. 29, 1999

(51) Int. Cl.[7] ..... A45B 25/02; A45B 25/22
(52) U.S. Cl. ..... 135/31; 135/27; 135/29
(58) Field of Search ..... 135/27, 29, 31, 135/32, 25.34

(56) References Cited

U.S. PATENT DOCUMENTS 843,092 * 2/1907 McGuire .
950,913 * 3/1910 Hartzell .
990,551 * 4/1911 Hartzell .
1,096,647 * 5/1914 Stein .
1,206,667 * 11/1916 Carlson .
1,397,794 * 11/1921 Chase .
1,964,292 * 6/1934 Livingston .
3,780,748 * 12/1973 Weber .
3,902,514 * 9/1975 Weber ..... 135/27 X
5,435,331 * 7/1995 Okuda ..... 135/29
5,553,634 * 9/1996 Yang ..... 135/31 X
5,836,328 * 11/1998 Lee ..... 135/31 X
6,058,952 * 5/2000 Lin et al. ..... 135/29

FOREIGN PATENT DOCUMENTS

771518 * 4/1957 (GB) ..... 135/31

* cited by examiner

*Primary Examiner*—Robert Canfield
(74) *Attorney, Agent, or Firm*—A & J

(57) ABSTRACT

A skeleton for umbrellas includes an elongated shank, a runner slidably mounted on the shank, a sleeve slidably fitted on the shank and arranged above the runner, a spring disposed between the runner and the sleeve, and a joint fixedly secured to an upper end of the shank, characterized in that a plurality of primary stretchers are pivotally connected with the sleeve, a plurality of secondary stretchers having an end pivotally connected with an upper end of the runner and having another end pivotally connected with an intermediate portion of a respective one of the primary stretchers, a plurality of reinforcing arms pivotally connected at a first end thereof with another end of a respective one of the primary stretchers, and a plurality of ribs pivotally connected at an end with the joint and pivotally connected with a second end of a respective one of the reinforcing arms.

3 Claims, 5 Drawing Sheets

STRUCTURE OF A SKELETON FOR UMBRELLAS

BACKGROUND OF THE INVENTION

1. Field of the Invention

This invention is related to an improvement in the structure of a skeleton for umbrellas.

2. Description of the Prior Art

Referring to FIG. 1, the conventional skeleton for umbrellas generally includes a shank A1, a runner A2, a plurality of primary stretchers A4, a plurality of second stretchers A3, a plurality of connectors A6, and a plurality of ribs A5. The shank A1 is an elongated member on which is slidably mounted the runner A2. The upper end of the runner A2 is pivotally connected with a plurality of the second stretchers A3. The primary stretchers A4 are pivotally connected at an end to a sleeve slidably mounted on the shank A1 and located above the runner A2 and at the other end to the connectors A6. The connectors A6 are fixedly installed on the intermediate portions of the ribs A5. However, in case of strong wind, the canopy of the umbrella will be easily overturned and the ribs A5 will be deformed or even broken thereby rendering the umbrella unfit for practical use.

Therefore, it is an object of the present invention to provide an improvement in the strict ire of a skeleton for umbrellas which can obviate and mitigate the above-mentioned drawbacks.

SUMMARY OF THE INVENTION

This invention is related to an improvement in the structure of a skeleton for umbrellas.

It is the primary object of the present invention to provide an improved skeleton for umbrellas which utilizes a plurality reinforcing arms to reinforce the strength of the ribs for withstanding the wind force.

It is another object of the present invention to provide an improved skeleton for umbrellas which can lessen the force applied by the wind to the rib by means of moving the fulcrum from the first end to the second end of the reinforcing arm.

It is still another object of the present invention to provide an improved skeleton for umbrellas wherein the reinforcing arm is configured to engage with the lower side of the rib for reinforcing the rib.

It is still another object of the present invention to provide an improved skeleton for umbrellas which can facilitate the restoration of the canopy.

It is still another object of the present invention to provide an improved skeleton for umbrellas which is simple in construction and low in cost.

It is a further object of the present invention to provide an improved skeleton for umbrellas which is fit for practical use.

According to a preferred embodiment of the present invention, a skeleton for umbrellas includes an elongated shank, a runner slidably mounted on the shank, a sleeve slidably fitted on the shank and arranged above the runner, a spring disposed between the runner and the sleeve, and a joint fixedly secured to an upper end of the shank, characterized in that a plurality of primary stretchers are pivotally connected with the sleeve, a plurality of secondary stretchers having an end pivotally connected with an upper end of the runner and having another end pivotally connected with an intermediate portion of a respective one of the primary stretchers, a plurality of reinforcing arms pivotally connected at a first end thereof with another end of a respective one of the primary stretchers, and a plurality of ribs pivotally connected at an end with the joint and pivotally connected with a second end of a respective one of the reinforcing arms.

The foregoing objects and summary provide only a brief introduction to the present invention. To filly appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
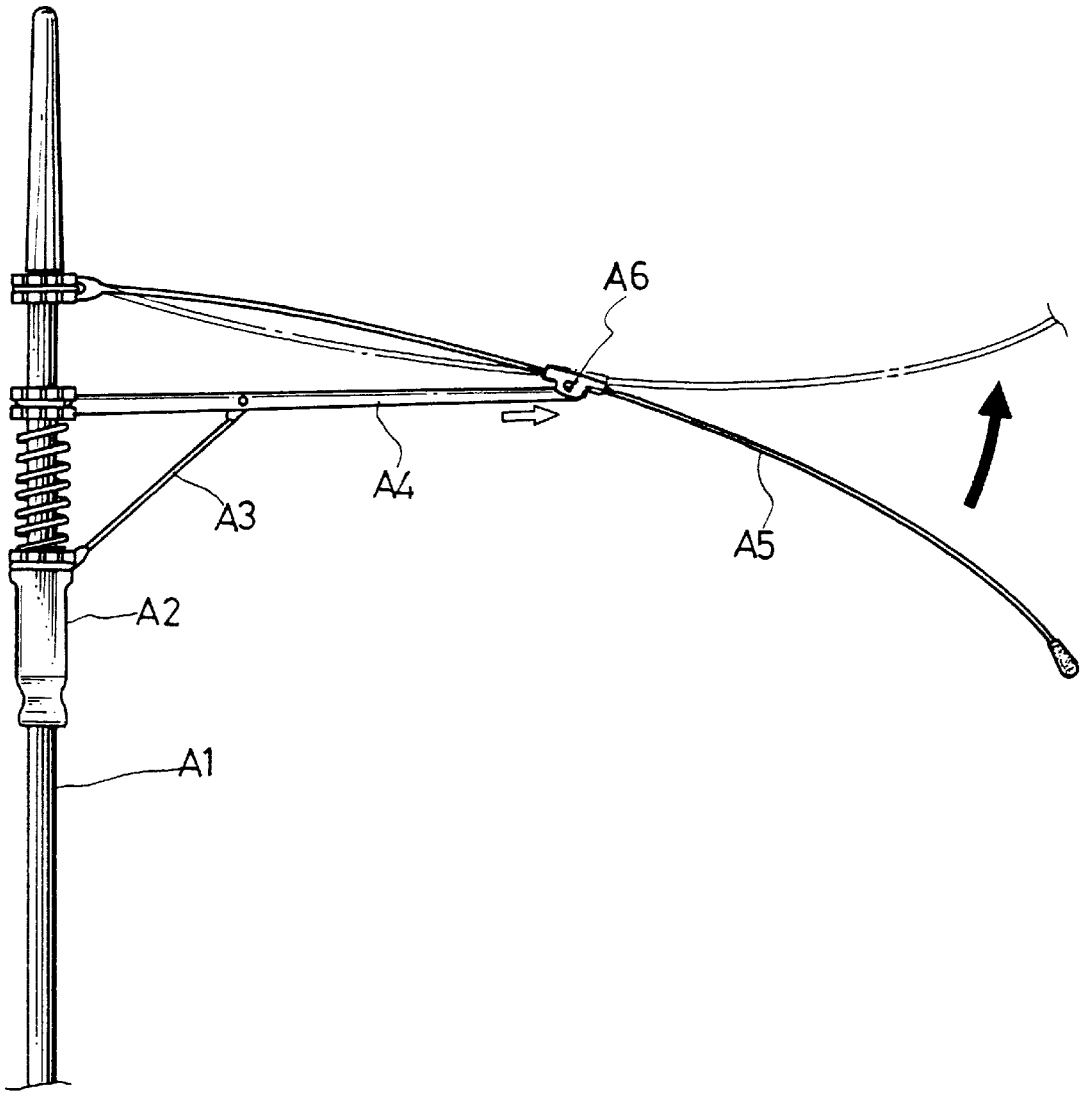
PRIOR ART FIG. 1
FIG. 1 illustrates the structure of a prior art skeleton for umbrellas.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
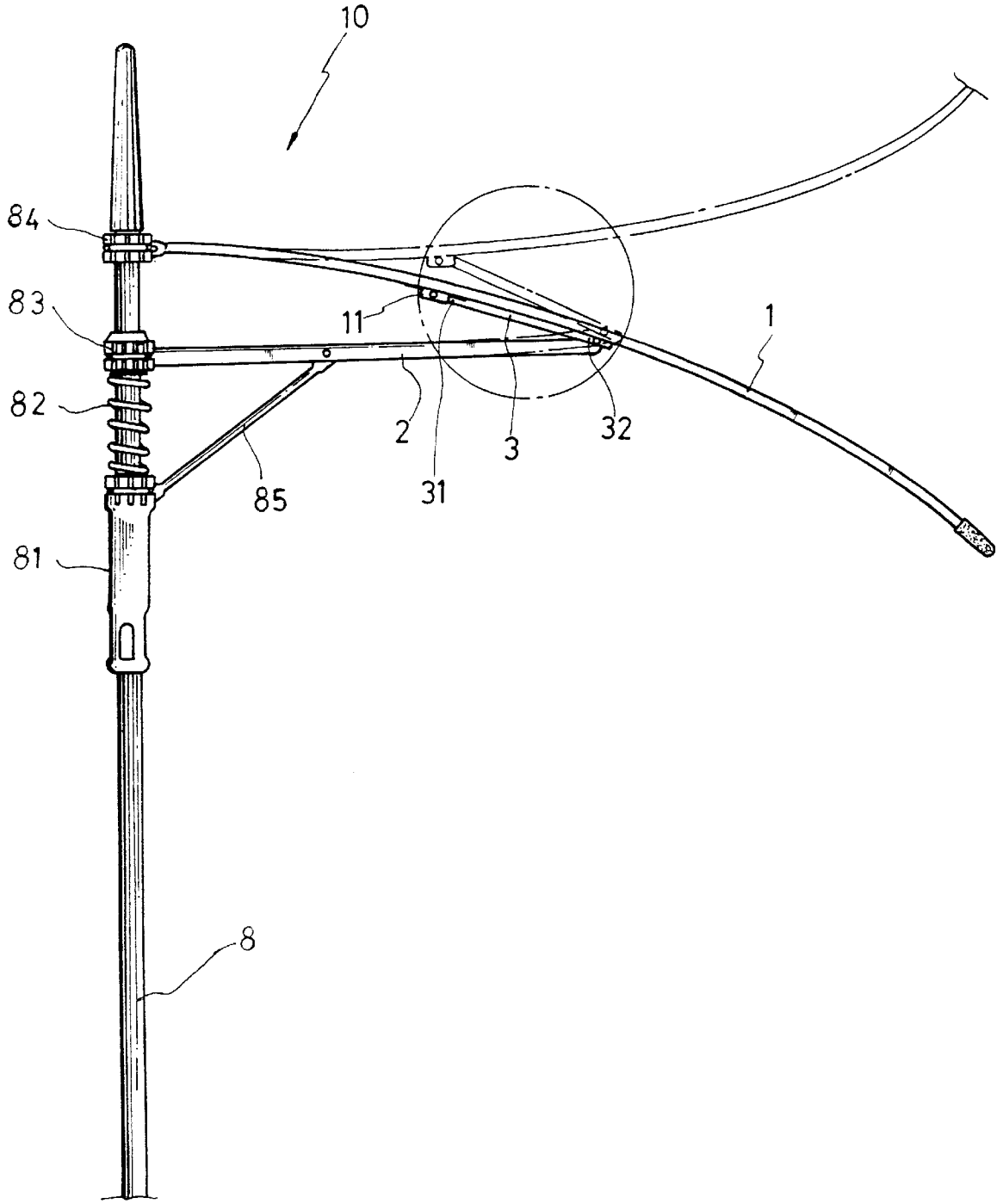
FIG. 2 illustrates the structure of a skeleton for umbrellas according to the present invention.
Figure 3:
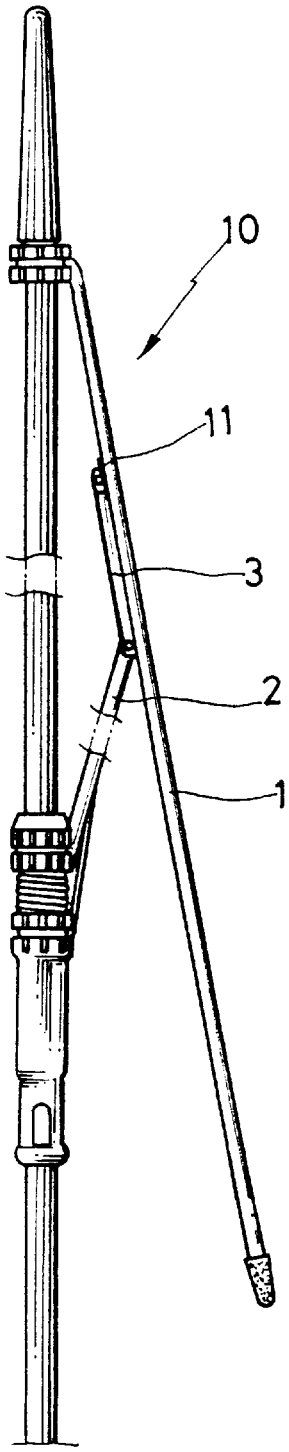
FIG. 3 illustrates how the present invention is collapsed.

With reference to the drawings and in particular to FIGS. 2 and 3, the skeleton 10 for umbrellas according to the present invention generally comprises a shank 8, a runner 81, a spring 82, a sleeve 83, a joint 84, a plurality of primary stretchers 2 (only one is shown for clarity), a plurality of secondary stretchers 85 (only one is shown for clarity), a plurality of ribs 1 (only one is shown for clarity), and a plurality of reinforcing arms 3 (only one is shown for clarity).

The shank 8 is an elongated member on which is slidably mounted the runner 81. The sleeve 83 is slidably fitted on the shank 8 and arranged above the runner 81. The spring 83 is disposed between the runner 81 and the sleeve 83. The joint 84 is fixedly secured to the upper end of the shank 8. The sleeve 83 is pivotally connected with the primary stretchers 2 so that the primary stretchers 2 can be folded with respect to the sleeve 83 on the shank 8. The upper end of the runner 81 are pivotally connected with the secondary stretchers 85 so that the secondary stretchers 85 can be folded with respect to the upper end of the runner 81 on the shank 8. The other end of each of secondary stretchers 85 is pivotally connected with an intermediate portion of a respective one of the primary stretchers 2. The other end of each of the primary stretchers 2 is pivotally connected with a first end 32 of a respective one of reinforcing arms 3. The second end 31 of each of the reinforcing arms 3 is pivotally connected with a connector 11 mounted on the lower side of an intermediate portion of a respective rib 1 and the inner ends of the ribs 1 are pivotally connected with the joint 84, so that the reinforcing arm 3 is always positioned under the rib 1 thereby reinforcing the strength of the rib 1 for withstanding strong wind.

Figure 4A:
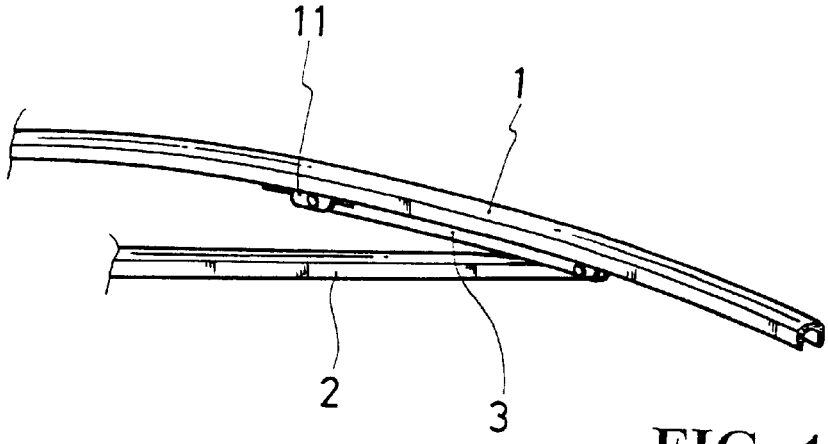
FIGS. 4A and 4B illustrate the relationship between the rib, the stretcher and the supporting arm of the present invention.
Figure 4B:
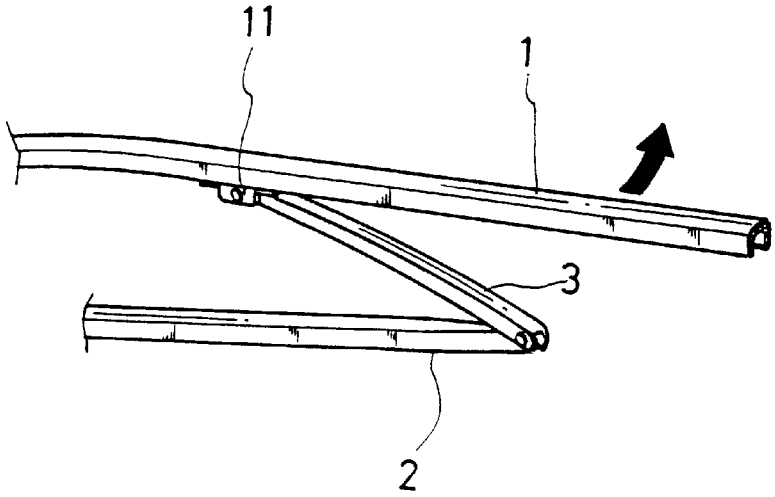

Referring to FIGS. 4A and 4B, the reinforcing arm 3 not only can reinforce the strength of the rib 1, but also can lessen the force applied by the wind to the rib 1 by means of moving the fulcrum from the first end 32 of the reinforcing arm 3 to the second end 31 of the reinforcing arm 3. Accordingly, the present invention can prevent the canopy (not shown) of an umbrella from turning over and make it easier to restore the canopy.

As shown in FIGS. 4A and 4B, the rib 1 is an inverted U-shaped member and the reinforcing arm 3 is configured to fit into the rib 1.

Figure 5A:
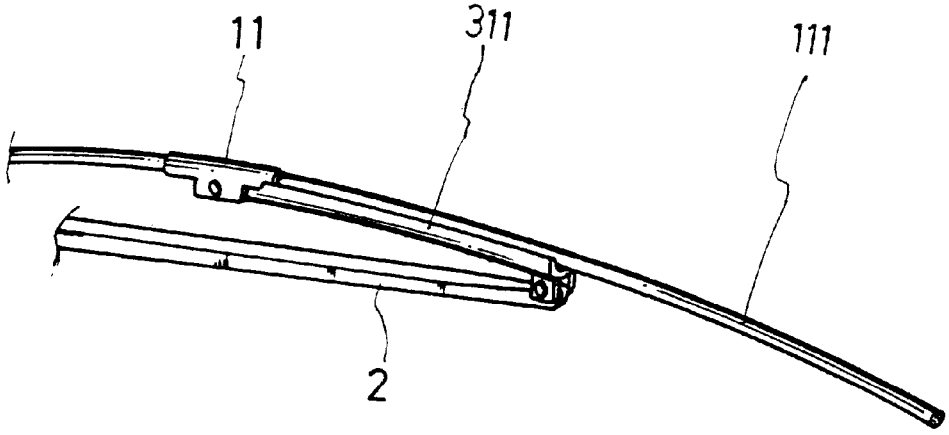
FIGS. 5 and 5B illustrate another preferred embodiment of the present invention.
Figure 5B:
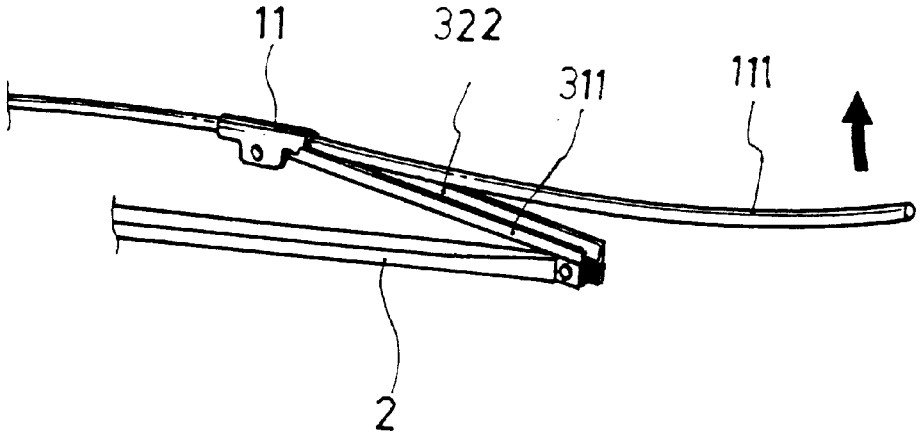

FIGS. 5A and 5B illustrate another preferred embodiment of the present invention. As shown, the rib 111 has a circular cross section and the reinforcing arm 311 has a circular recess 322 configured to receive the rib 111.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. In a skeleton for umbrellas comprising an elongated shank, a runner slidably mounted on said shank, a sleeve slidably fitted on said shank and arranged above said runner, a spring disposed between said runner and said sleeve, and a joint fixedly secured to an upper end of said shank, characterized in that a plurality of primary stretchers are pivotally connected with said sleeve, a plurality of secondary stretchers having an end pivotally connected with an upper end of said runner and having another end pivotally connected with an intermediate portion of a respective one of said primary stretchers, a plurality of reinforcing arms pivotally connected at a first end thereof with another end of a respective one of said primary stretchers, and a plurality of ribs pivotally connected at an end with said joint and pivotally connected with a second end of a respective one of said reinforcing arms.

2. The skeleton for umbrellas as claimed in claim 1, wherein said ribs are an inverted U-shaped member and said reinforcing arms are configured to fit in said ribs.

3. The skeleton for umbrellas as claimed in claim 1, wherein said ribs have a circular cross section and said reinforcing arms each have a circular recess configured to receive a respective one of said ribs.

* * * * *